US009700156B1

(12) United States Patent
Hance et al.

(10) Patent No.: US 9,700,156 B1
(45) Date of Patent: Jul. 11, 2017

(54) EXTENDABLE SHELF DIVIDERS

(75) Inventors: Christopher D. Hance, Sammamish, WA (US); Darryl Jensen, Woodburn, OR (US)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 1284 days.

(21) Appl. No.: 12/248,361

(22) Filed: Oct. 9, 2008

(51) Int. Cl.
*A47F 5/00* (2006.01)

(52) U.S. Cl.
CPC ..... *A47F 5/005* (2013.01)

(58) Field of Classification Search
USPC ..... 211/184, 42, 43, 188, 194, 59.2, 59.3; 312/35; 108/60, 61; 220/500; 206/529, 206/534, 561; 248/227.1, 227.4, 235; 403/329
See application file for complete search history.

(56) References Cited

U.S. PATENT DOCUMENTS 575,294 A * 1/1897 Borden ..... 211/184
767,037 A * 8/1904 Brett ..... 108/61
2,658,628 A * 11/1953 Hilgen ..... 211/184
2,747,959 A * 5/1956 Ingelson ..... 312/140.3
3,712,539 A * 1/1973 Staats ..... 238/10 E
3,780,876 A * 12/1973 Elkins ..... 211/184
3,868,021 A * 2/1975 Heinrich ..... 211/184
4,676,384 A * 6/1987 Schafer ..... 211/184
4,712,694 A * 12/1987 Breslow ..... 211/184
4,729,485 A * 3/1988 Kulbersh ..... 211/184
4,889,253 A * 12/1989 Schmulian et al. ..... 220/551
5,217,124 A * 6/1993 Stone ..... 211/184
5,381,908 A * 1/1995 Hepp ..... 211/184
5,458,248 A * 10/1995 Alain ..... 211/175
5,555,687 A * 9/1996 Logan et al. ..... 52/288.1
5,579,997 A * 12/1996 Jackson et al. ..... 238/10 R
5,682,824 A * 11/1997 Visk ..... 108/60
5,685,664 A * 11/1997 Parham et al. ..... 403/393
5,803,276 A * 9/1998 Vogler ..... 211/184
6,098,821 A * 8/2000 Dube et al. ..... 211/184
6,889,856 B2 * 5/2005 Clark et al. ..... 211/184
7,028,852 B2 * 4/2006 Johnson et al. ..... 211/59.3
7,163,119 B2 * 1/2007 Besselman ..... 220/551
7,182,209 B2 * 2/2007 Squitieri ..... 211/59.2
2002/0145094 A1 * 10/2002 Rieger ..... 248/242
2003/0037712 A1 * 2/2003 Welch et al. ..... 108/180
2004/0245197 A1 * 12/2004 McElvaney ..... 211/184
2005/0139560 A1 * 6/2005 Whiteside et al. .... 211/119.003
2006/0226104 A1 * 10/2006 Schmidt ..... 211/184
(Continued)

OTHER PUBLICATIONS

Exhibit A: Photograph of shelf divider in use prior to 2006 (month is not at issue).

*Primary Examiner* — Stanton L Krycinski
(74) *Attorney, Agent, or Firm* — Thomas|Horstemeyer, LLP.

(57) ABSTRACT

Disclosed are various embodiments of an extendable divider system. In one embodiment, such a divider system includes a base. A shelf divider extends from a surface of the base, the shelf divider having an extension connector component on at least one free end. A divider extension having a divider connector component configured to mate with the extension connector component is also disclosed. The divider connector component is configured to removably attach the divider extension to the extension connector component of the shelf divider.

20 Claims, 8 Drawing Sheets

Fig. 1

(56) References Cited

U.S. PATENT DOCUMENTS

| | | | | |
|---|---|---|---|---|
| 2007/0075028 | A1* | 4/2007 | Nagel et al. | 211/59.2 |
| 2007/0120452 | A1* | 5/2007 | Benz et al. | 312/400 |
| 2007/0175844 | A1* | 8/2007 | Schneider | 211/184 |

* cited by examiner

EXTENDABLE SHELF DIVIDERS

BACKGROUND

In a warehouse or fulfillment center environment, shelf dividers are used to separate shelves into separate bins and/or partitions. Inventory can be sorted according to various properties such as universal product code, international standard book number, stock-keeping unit, or other identifier and stored in separate bins according to such identifying property. In a warehouse or fulfillment center environment, products may be stacked in such a bin or partition and risk spilling or falling into adjacent bins or elsewhere, resulting in lost or misplaced inventory.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
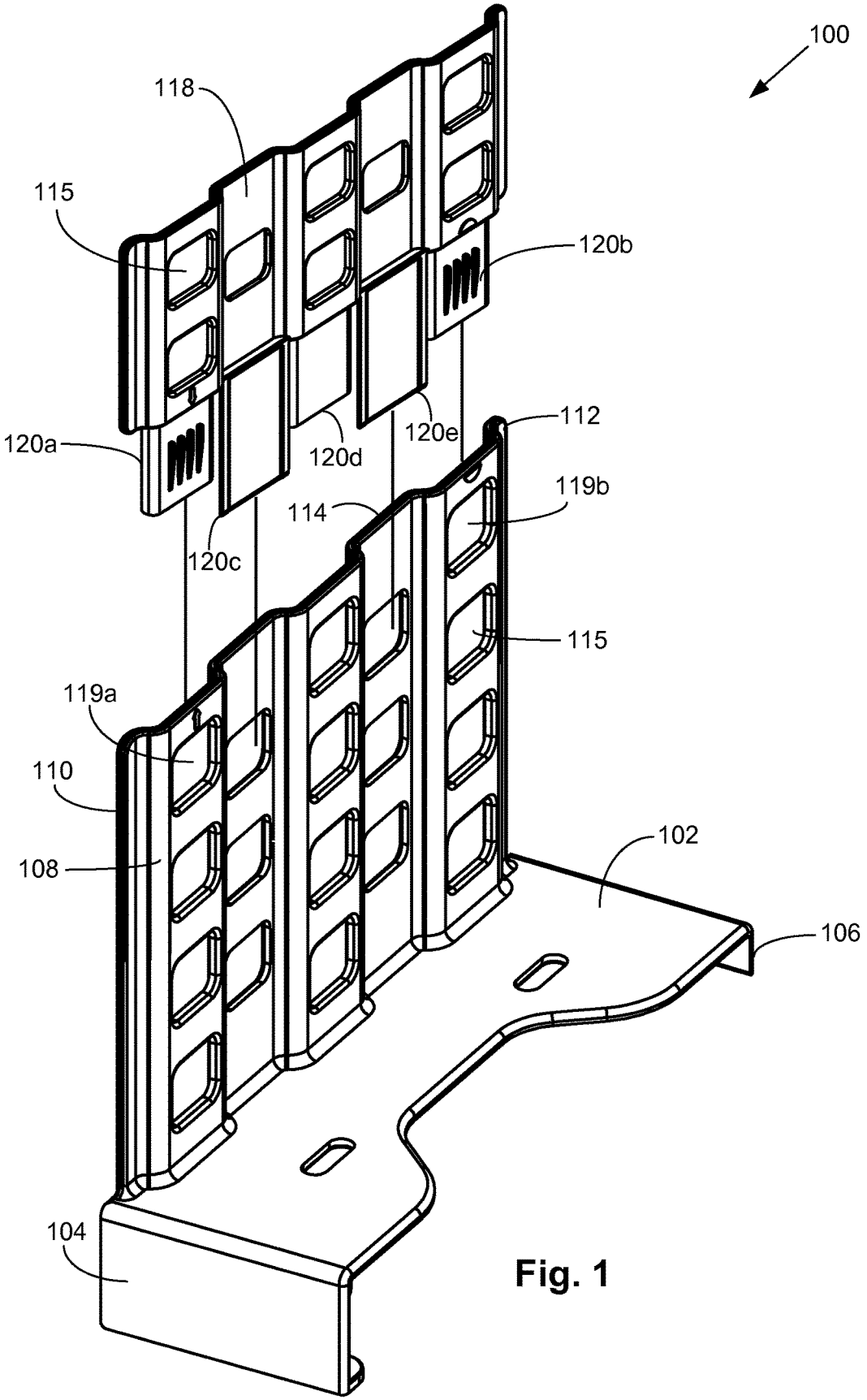
FIG. 1 is a drawing of one embodiment of a divider system according to an embodiment of the present disclosure.

With reference to FIG. 1, shown is one example of a divider system 100. A divider system 100 in accordance with the disclosure can be configured to divide an elongated surface, such as a shelf. Such an elongated surface can also include, but is not limited to, a desk, credenza, or other surface. The divider system 100 can also be configured to divide a substantially planar shelf, wire frame shelf, or other types of surfaces that should be appreciated. While the divider system 100 is primarily discussed herein with reference to its application with substantially planar and/or wire frame shelves, it should be appreciated that the disclosed systems and methods can be utilized with various surfaces and/or systems.

Accordingly, the depicted divider system 100 includes a base 102 that is configured to be disposed on a shelf or other surface. The base further has a first side 104 and a second 106 side that bound the base 102. In other words, the first side 104 and second side 106 bound the base 102 and define a depth of the base. The base 102 is further configured to span the depth of a shelf. Additionally, the width of the first side 104 and/or second side 106 can be configured to be of sufficient size to accommodate placement of labels containing bar codes, text, and/or other markings reflecting the above noted product identifying information corresponding to a particular bin and/or partition created by the divider system 100. In addition, the base 102 can be configured to extend in a particular direction relative to the depicted shelf divider 108 to communicate to a user whether such labels or other markings correspond to a bin and/or partition appearing to the left and/or right of the shelf divider 108.

A shelf divider 108 extends from the base 102 and is configured to divide a shelf into separate bins and/or partitions. As noted above, division of a shelf into bins and/or partitions can facilitate warehouse and/or fulfillment center operations employing shelves for storage of product inventory. In the depicted non-limiting example, the shelf divider 108 extends from the base 102 oriented in a plane that is substantially perpendicular to the plane associated with the base 102. In other words, the shelf divider 108 is oriented in a substantially vertical direction while the upper surface 102 of the base is oriented in a substantially horizontal direction relative to the shelf divider 108. However, it should be appreciated that the depicted divider system 100 is but one example embodiment, and that other configurations and/or orientations can be employed The depicted shelf divider 108 includes free ends 110, 112, 114. The depicted free ends 110, 112, 114 are "free" in that they are not coupled to or extending from the base 102. For example, the shelf divider 108 is illustrated as a rectangular body having a top end 114, a front end 110, and rear end 112. Accordingly, to facilitate discussion and identification of the depicted free ends 110, 112, 114 herein, such nomenclature may be used herein with reference to the divider system 100. However, it should be appreciated that such nomenclature is merely exemplary, and that a shelf divider 108 may be employed having various shapes, orientations and/or sides.

The depicted shelf divider 108 further includes one or more apertures 115 oriented throughout the divider 108. The depicted apertures 115 are oriented throughout the body of the divider 108 in a staggered fashion in order to retain structural rigidity of the divider 108. The depicted apertures 115 can be employed in order to reduce manufacturing cost, material cost, and/or weight of the divider system 100. In addition, the depicted shelf divider 108 further includes a corrugated body in order to further improve structural rigidity of the divider system 100.

The depicted shelf divider 108 also includes a divider extension 118. The divider extension 118 is configured to extend the height, width, or other dimensions of the divider system 100 and can be employed when needed to limit lost or misplaced inventory in a warehouse and/or fulfillment center operation. As noted above, inventory in such an environment may fall and/or spill from bins and/or partitions created by a divider system 100. Accordingly, the depicted divider extension 118 can be employed to extend the height and/or width of the divider system 100 to prevent such spillage of inventory. Similar to the shelf divider 108, the divider extension 118 can likewise include one or more apertures 115 configured to reduce manufacturing cost, materials cost and/or weight of the divider system 100. In addition, as noted above in reference to the shelf divider 108, the divider extension 118 can also include a corrugated body employed for increasing the structural rigidity of the divider extension 118. The additional apertures 115 can also allow an additional divider extension 118 to be employed to further extend the height and/or width of the divider system 100. In this way, the additional apertures 115 can form an additional connection system allowing divider extensions 118 to be "daisy chained" or attached to additional divider extensions 118 and/or shelf dividers 108, which provides additional configurability and extendibility.

The shelf divider 108 and divider extension 118 can be connected to one another through use of a connection system configured to facilitate removable attachment a shelf divider 108 and a divider extension 118. In the depicted example, such a connection system includes one or more connector tabs 120 configured to attach a divider extension 118 at a free end 110, 112, 114 of the shelf divider 108. A connector tab may further include projections extending from a side of the connector tab 120 to facilitate snap fitting of the shelf divider 108 and the divider extension 118. The connection system can include corresponding connector apertures 119 on the shelf divider 108 configured to mate with projections extending from a side of the connector tabs 120 on the divider extension 118 to restrict longitudinal movement of the divider extension 118 relative to the shelf divider 108. As a result, the one or more connector tabs 120 are configured to secure the divider extension 118 to the shelf divider 108 and extend (in the depicted non-limiting example) the height of the divider system 100.

Connector tabs 120 may also include tabs 120*c*, 120*d*, 120*e* configured to stabilize the mating of a shelf divider 108 and divider extension 118 by restricting lateral movement of the divider extension 118 relative to the shelf divider 108. Connector tabs 120 may be positioned on opposing sides of the shelf divider 108 and/or divider extension 118. While the depicted connector tabs 120 extend from the divider extension 118, it should be appreciated that one or more connector tabs 120 may also extend from the shelf divider 108. It should be appreciated that a connection system can include various combinations of connector tabs 120, apertures 119 and/or other connector components to facilitate snap-fitting of the divider extension 118 and shelf divider 108.

It should be appreciated that such mating of connector tabs and/or apertures can also be employed to attach a divider extension 118 to the front end 110 and/or rear end 112 of the shelf divider 108 to extend the size of the divider system 100 in any dimension. In addition, while the depicted connection system is but one example, a connection system can further include other combinations of connector tabs and/or connector apertures. As one alternative non-limiting example, divider extension 118 may include a combination of connector tabs and connector apertures configured to snap fit the extension 118 to a corresponding combination of connector tabs and connector apertures on the shelf divider 108. A connection system may additionally include other clamping systems, male/female connectors, or other systems and/or devices that can be employed to mechanically couple the shelf divider 108 and divider extension 118.

Additionally, according to one embodiment, the disclosed connector apertures 119*a*, 119*b* and/or connector tabs 120*a*-120*e* may together create a connector. As one example, the connector components such as connector apertures 119*a*, 119*b* on a shelf divider 108 may be referred to herein as extension connector components as they are configured to facilitate attachment to a divider extension 118. Likewise, the connector components such as connector tabs on a divider extension 118 may be referred to as divider connector components as they facilitate attachment to a shelf divider 108. Therefore, it should be appreciated that the divider and extension connector components such as the connector apertures 119*a*, 119*b* and connector tabs 120*a*-120*e* can be replaced with various types of other connector components and/or devices.

A divider system 100 in accordance with the disclosure can be constructed from various materials depending on the desired structural rigidity, manufacturing cost, safety regulations and other factors. As a non-limiting example, federal and/or state safety laws and/or regulations may dictate use of a particular material in construction of the divider system due to fumes that emanate therefrom. Accordingly, components of the divider system 100 can be constructed from at least one of a resin, plastic, fiberglass, wood, metal, metal alloy, and/or other materials as can be appreciated. In addition, the divider system 100 can be constructed in a variety of heights, widths, shapes and configurations in accordance with the disclosure.

Accordingly, the disclosed divider system 100 can be used in conjunction with a plurality of such divider systems 100 in accordance with the disclosure to divide a shelf and/or other surface into various bins or partitions. In one example, in a warehouse and/or fulfillment center setting, various types of inventory may be stored on one or more shelves in a warehouse, which can be retrieved or picked from the one or more shelves for shipping or other fulfillment. Inventory in such a warehouse and/or fulfillment center may be sorted according to various properties or product identifying information that can include, but are not limited to, model number, universal product code, stock-keeping unit number (SKU), international standard book number (ISBN), or other identifying feature. The sorted inventory may be stored in various bins or partitions that are facilitated by the use of one or more of the divider systems 100 in conjunction with one or more shelves. Such sorting and storing of inventory in various bins created by one or more divider systems 100 in a warehouse or fulfillment center setting can facilitate efficient subsequent picking and/or retrieval of inventory.

The depicted divider system 100 is also configurable and extendable. In one non-limiting exemplary scenario, inventory stored in various bins and/or partitions on a shelf can be stacked in its respective bin depending on the amount of inventory on hand. Accordingly, use of a configurable and extendable divider system 100 can prevent inventory from falling and/or spilling from its assigned bin and/or partition into an adjacent bin and/or partition that may be assigned to inventory having different properties. As a consequence, inventory is stopped from becoming lost or misplaced. As a non-limiting example, books sorted by a certain ISBN that are stored in a particular bin may be stacked to a height that exceeds a prior art shelf divider, which may result in a certain number of the books spilling into an adjacent bin that is assigned to books having a different ISBN. In addition, in such a non-limiting scenario, the books may appear to be visually similar. Therefore, workers or other systems in a warehouse or fulfillment center may be unable to easily notice that such spillage has occurred, resulting in lost or misplaced inventory. In a warehouse and/or fulfillment center, avoidance of lost or misplaced inventory can result in increased efficiency of warehouse or fulfillment center operations.

The divider system 100 can be employed to divide a shelf or other surface constructed from rubber, silicone, wood, steel, plastic, resin, and other alloys and/or composites. Further, the divider system 100 can be used with a shelf having a wire frame or other similar construction. In other words, the disclosed divider system 100 can be used to divide a shelf or other surface having gaps, apertures and/or holes that can accompany a wire frame construction of a shelf and/or other surface. It should be appreciated that such a wire frame construction that can be employed in a shelf and/or shelving system can include one or more of substantially parallel longitudinal members that are intersected by a plurality of cross members oriented substantially perpendicular to the longitudinal members.

Figure 2:
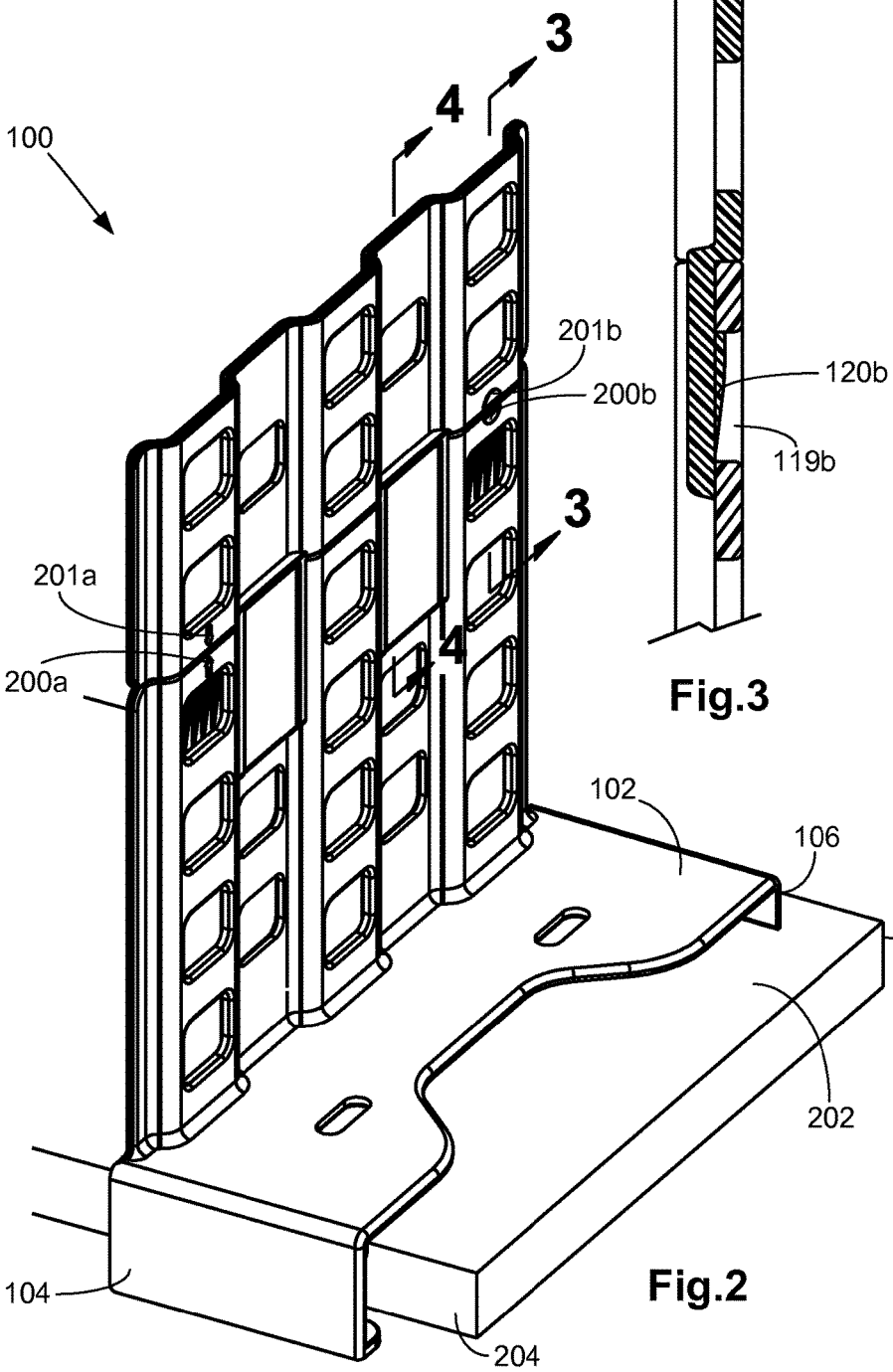
FIG. 2 is a drawing of the divider system of FIG. 1 in operation with a shelf according to an embodiment of the present disclosure.

Reference is now made to FIG. 2, which illustrates an alternative depiction of the divider system 100 of FIG. 1. More specifically, FIG. 2 depicts a divider system 100 having a shelf divider 108 and divider extension 118 removably engaged via a connection system. In the depicted example, as noted above, the connector apertures 119*a*, 119*b* and connector tabs 120*a*-120*e* are employed. The divider extension 118 extends the vertical height of the divider system 100 as it is removably attached to the shelf divider 108. A divider extension 118 can also be configured to removably attach to other sides of the shelf divider 108 in order to extend the size of the divider system 100 in other dimensions as well.

The depicted divider system 100 further includes a shelf divider 108 having alignment markings 200*a*, 200*b* that are configured to align with alignment markings 201*a*, 201*b* of the divider extension 118. In addition, the alignment markings 200*a*, 200*b* can be distinct from one another to assist a user in properly removably attaching a divider extension 118 having corresponding distinct alignment markings 201*a*, 201*b*.

FIG. 2 further depicts a divider system 100 in operation with a shelf 202. In other words, the depicted divider system 100 is coupled to the shelf 202 via the base 102 of the divider system 100. In one non-limiting example, the base 102 of the divider system 100 includes a first side 104 and a second side 106 that are configured to facilitate securing the base 102 to the shelf 204. The depicted first side 104 of the base is configured to extend at least partially around a first shelf side 204 and the second side 106 of the base is likewise configured to extend at least partially around a second shelf side 206. As a result, the first side 104 and second side 106 of the base can facilitate stability of the divider system 100 with respect to the shelf 202 as well as resistance to movement in a warehouse and/or fulfillment center environment.

Figure 3:
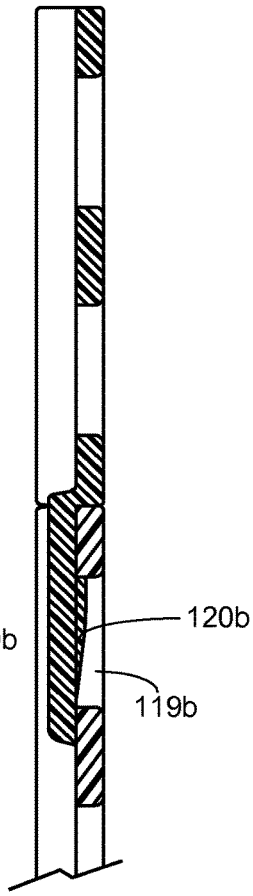
FIG. 3 is a cross-sectional view of a portion of the divider system of FIG. 1 in operation according to an embodiment of the present disclosure.

Reference is now made to FIG. 3, which depicts a cross-sectional view of a shelf divider 108 (FIG. 1) mated with a divider extension 118 (FIG. 1). According to the connection system described above, in the depicted non-limiting example, the connector apertures 119*b* are configured to mate with the connector tabs 120*b* of the divider extension 118. Therefore, one or more projections that extend from one side of the connector tab 120*b* are configured to snap fit into the connector aperture 119*b*. The connector tab 120*b* therefore facilitates securing the divider extension 118 to the shelf divider 108 by restricting longitudinal movement of the divider extension 118 relative to the shelf divider 108. It should again be noted that other connection systems including various types of connector or attachment devices and methods can be employed to removably attach a divider extension 118 and a shelf divider 108, and the depicted FIG. 3 is but one non-limiting example.

Figure 4:
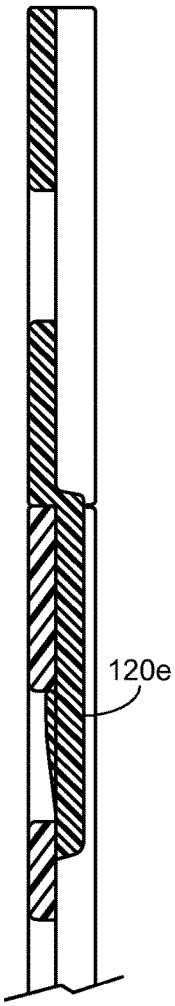
FIG. 4 is an alternative cross-sectional view of a portion of the divider system of FIG. 1 in operation according to an embodiment of the present disclosure.

Reference is now made to FIG. 4, which depicts a cross-sectional view of a portion of the shelf divider 108 (FIG. 1) mated with the divider extension 118 (FIG. 1). FIG. 4 depicts connector tab 120*e* of a connection system configured to attach a shelf divider 108 to a divider extension 118. The depicted non-limiting connector tab 120*e* is configured to extend from the divider extension 118 and restrict lateral movement of the divider extension 118 relative to the shelf divider 108.

Figure 5:
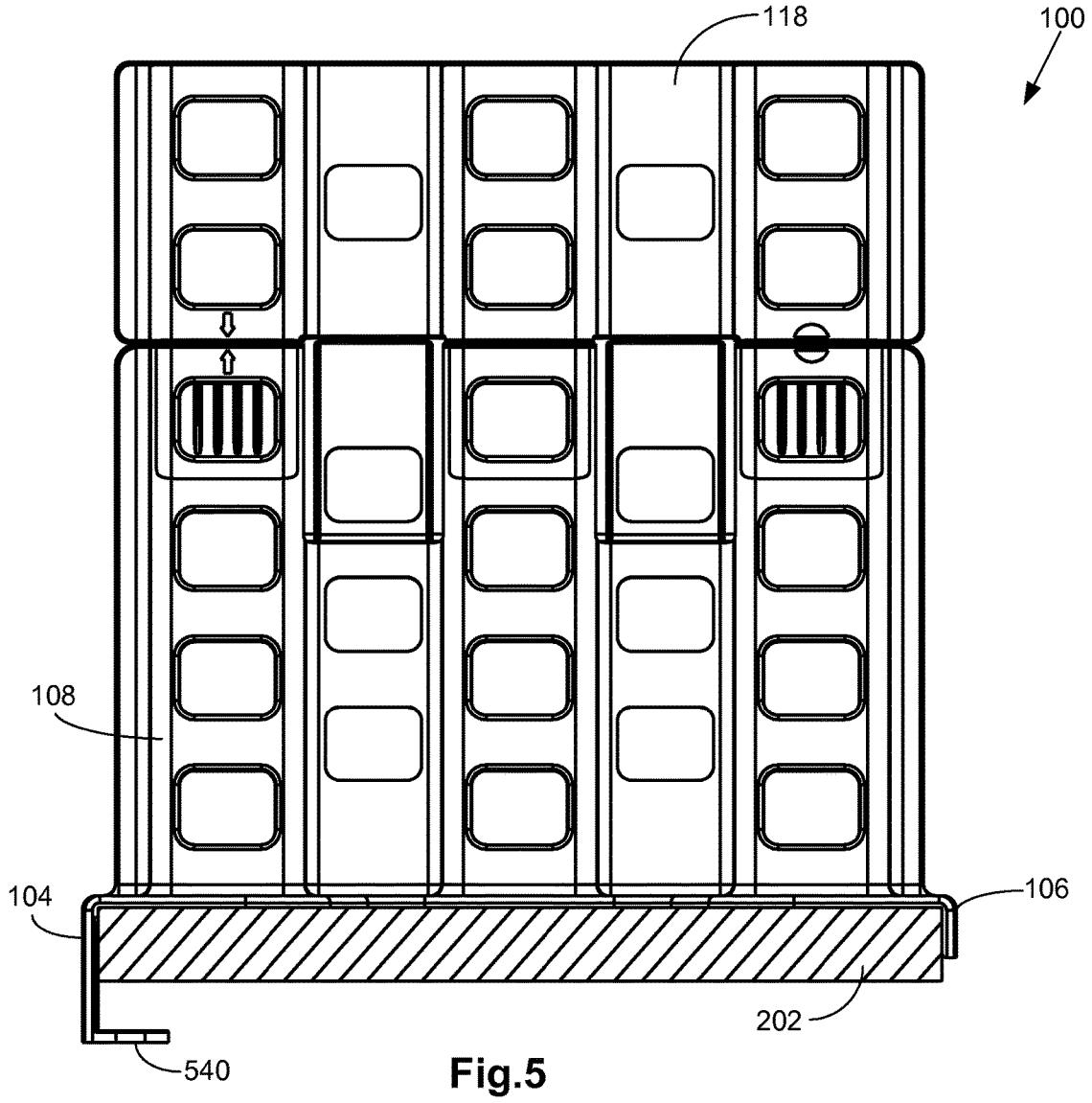
FIG. 5 is an alternative view of the divider system of FIG. 1 according to an embodiment of the present disclosure.

Reference is now made to FIG. 5, which depicts a side view of the divider system 100 of FIG. 1. FIG. 5 depicts a shelf divider 108 removably attached or snap fit to a divider extension 118. The depicted divider system 100 is also coupled to a shelf 202 via the base 102 (FIG. 1). As noted above in reference to FIG. 2, the base can further include a first side 104 and a second side 106 configured to secure and/or clamp the base 102 to the shelf 202. In the depicted example, the first side 104 can further include a shelf anchor 540 configured to extend around at least a portion of a bottom surface of the shelf 202 to clamp the divider system 100 to the shelf 202. It should be appreciated that such a shelf anchor 540 can increase the stability of a divider system 100 coupled to a shelf 202 in accordance with the disclosure. It should further be appreciated that variations of a shelf anchor 540 can also be employed in accordance with the disclosure. For example, the base can include an adjustable clamping system to snugly fit the divider system 100 to the shelf 202.

Figure 6:
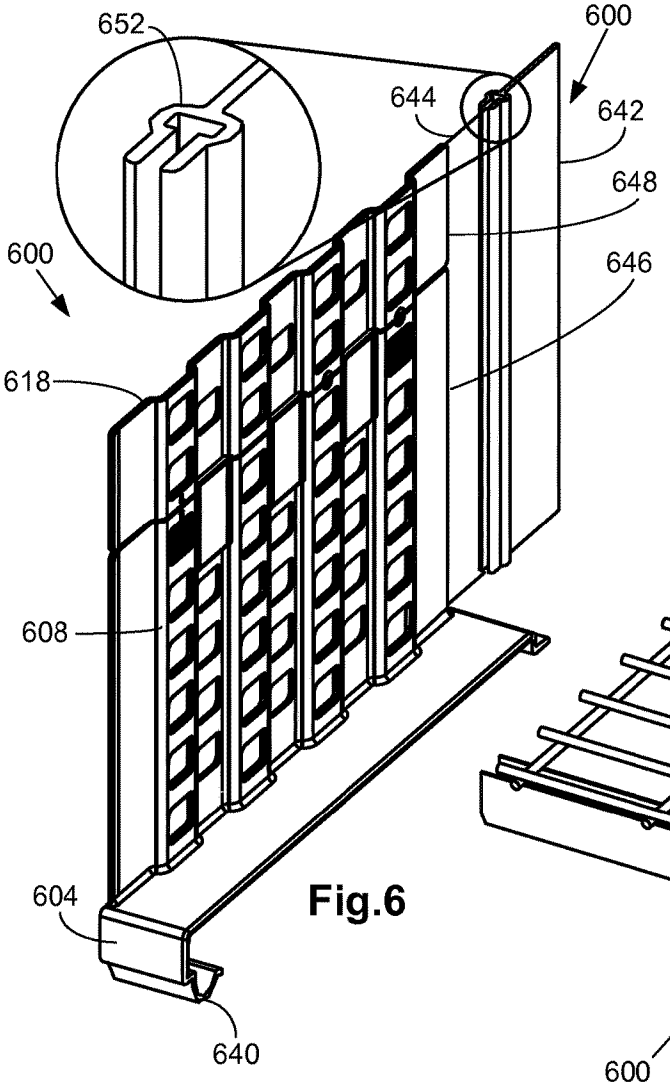
FIG. 6 is a drawing of an alternative non-limiting embodiment of a divider system of FIG. 1 according to an embodiment of the present disclosure.

Reference is now made to FIG. 6, which depicts an alternative non-limiting example of a divider system 600 in accordance with the disclosure. The divider system 600 of FIG. 6 depicts a shelf divider 608 coupled to a first divider extension 618 as well as a second divider extension 642. As a result, the divider system 600 is configured with multiple divider extensions 618, 642 that extend the size of the system 600 in two dimensions.

The divider system 600 includes a connector bridge 644 that is configured to connect the shelf divider 608, the first divider extension 618 and the second divider extension 642. The shelf divider 608*a*, 608*b* and first divider extension 618 include connector edges 646, 648 configured to attach the shelf divider 608*a*, 608*b* and first divider extension 618 to the connector bridge 644. The connector bridge 644 is further configured to allow the second shelf divider 642 to removably attach to both the shelf divider 608*a*, 608*b* and the first divider extension 618 via an extension clamp 652.

As noted above in reference to the connector apertures 119*a*, 119*b* (FIG. 1) and connector tabs 120*a*-120*e* (FIG. 1), according to one embodiment, the extension clamp 652 can also together with the disclosed connector apertures 119*a*, 119*b* and connector tabs 120*a*-120*e* create a connector. As one example, the connector components such as an extension clamp 652 and/or connector bridge 644 may also be referred to herein as divider connector components as they are configured to facilitate attachment to a divider extension 118 and/or shelf divider 108. Therefore, it should be appreciated that the divider and extension connector components such as the connector apertures 119*a*, 119*b*, connector tabs 120*a*-120*e*, and connector bridge 644, and extension clamp 652 can be replaced with various types of other connector components and/or devices.

Figure 7:
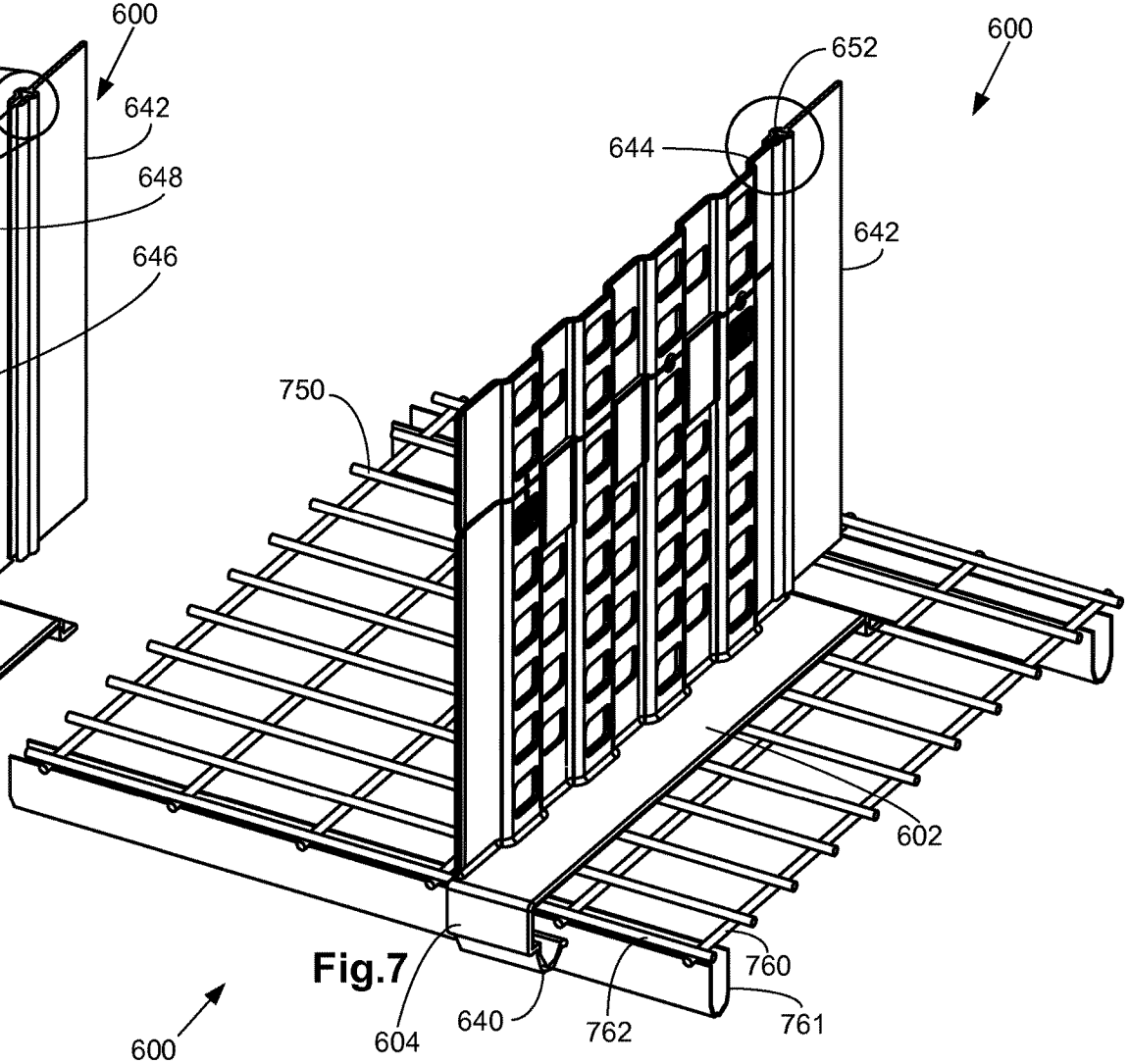
FIG. 7 is a drawing of the divider system of FIG. 6 in operation with a shelf according to an embodiment of the present disclosure.

Reference is now made to FIG. 7, which depicts the divider system 600 of FIG. 6 in operation. More specifically, the divider system 600 is coupled to a wire frame shelf 750.

In contrast to the divider system 100 of FIG. 1, the depicted divider system 600 is configured to facilitate creation of bins and/or partitions when used with a wire frame shelf 750 as opposed to a substantially planar shelf. As depicted, the wire frame shelf 750 includes at least one longitudinal member 760 intersected by a plurality of support members 761*a* or 761*b* and/or cross members 762.

The divider system 600 is configured with a first side 604*a* or 604*b* and a shelf anchor 640 that are configured to secure the base 602 of the divider system 600 to a support member 761*a* or 761*b* of the wire frame shelf 750. More specifically, the first side 604*a* or 604*b* of the base extends around at least a portion of the wire frame shelf 750, and the shelf anchor 640 secures the divider system 600 to the support member 761*a* or 761*b* of the wire frame shelf 750. It should also be appreciated that the shelf anchor 640 can also be configured to secure the divider system 600 to a cross member 762 or longitudinal member 760 of the wire frame shelf 750.

Figure 8:
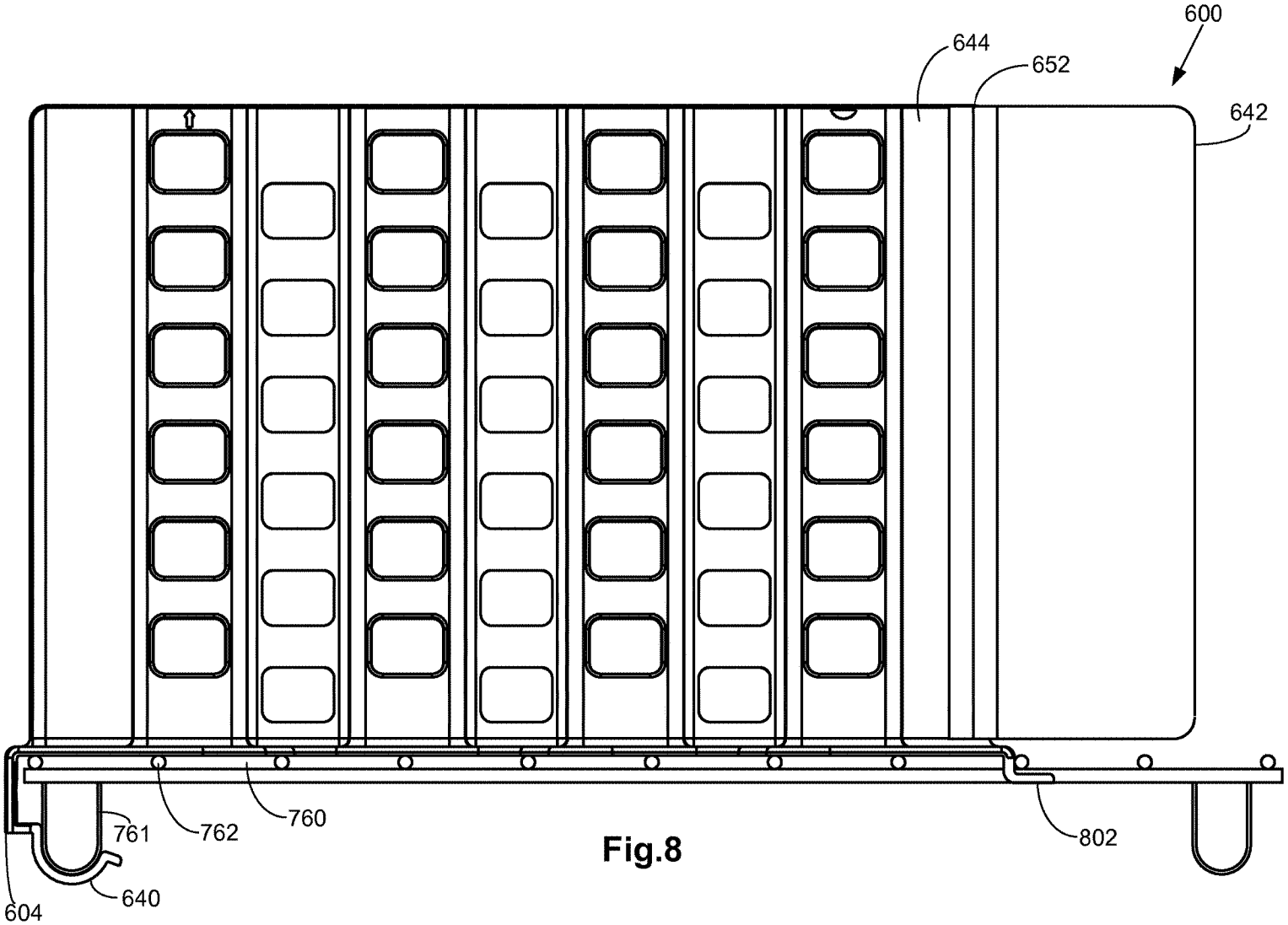
FIG. 8 is an alternative view of the divider system of FIG. 6 according to an embodiment of the present disclosure.

Reference is now made to FIG. 8, which illustrates an alternative depiction of the divider system 600 of FIG. 6. The side view of FIG. 8 illustrates the first side 604*a* or 604*b* of the base and shelf anchor 640 securing the divider system 600 to the wire frame shelf 750 (FIG. 7). In addition, the depicted divider system 600 includes an additional shelf anchor 802*a*, 802*b* configured to increase stability of the divider system 600 by creating an additional anchor point which anchors the divider system 600 to an additional cross member 762 of the wire frame shelf 750.

Figure 9:
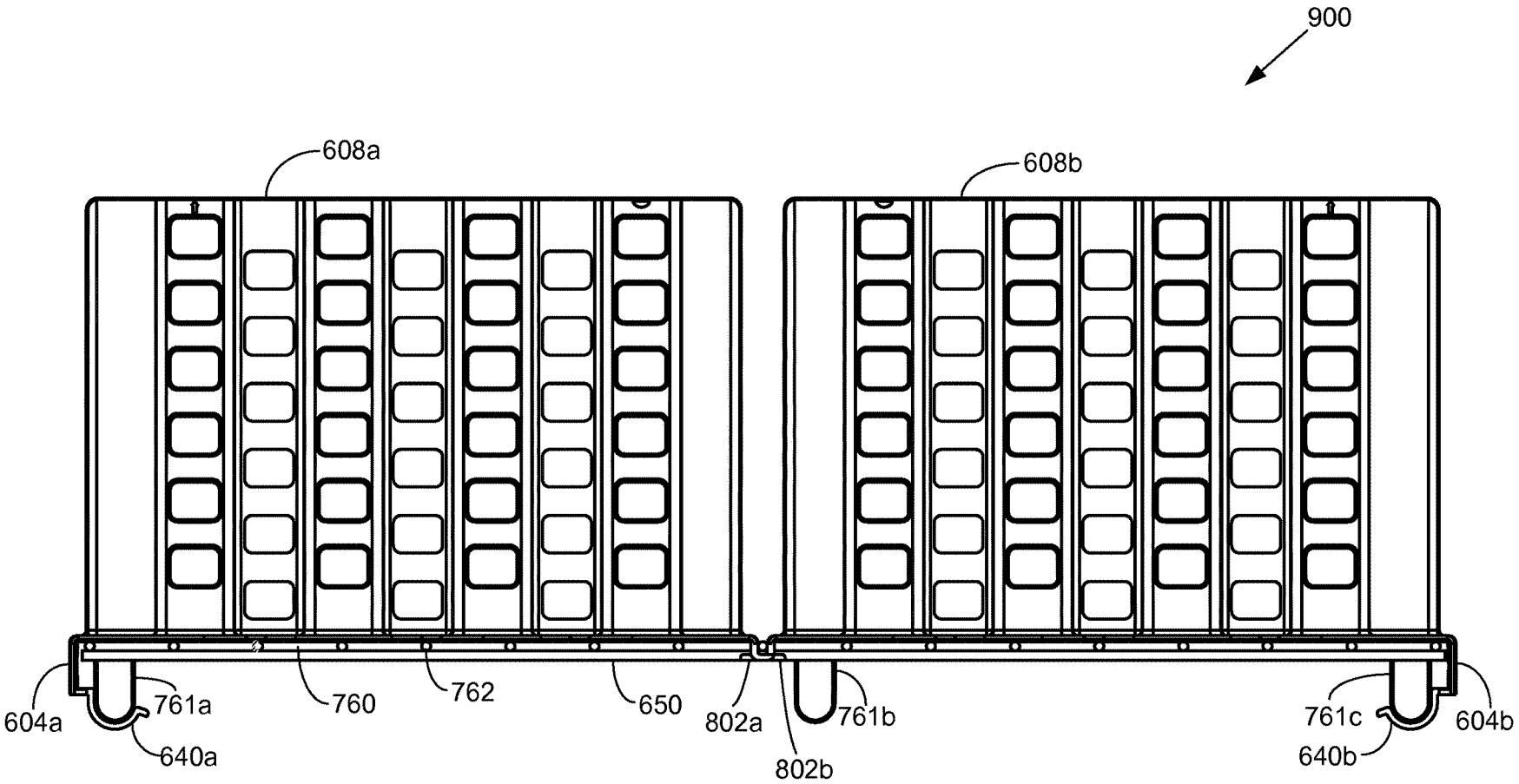
FIG. 9 is a drawing of an alternative non-limiting embodiment of a divider system according to an embodiment of the present disclosure.

Reference is now made to FIG. 9, which depicts yet another alternative illustration of a shelf divider 900 in accordance with the disclosure. In the depicted embodiment, a plurality of shelf dividers 608*a*, 608*b* are employed to facilitate usage of the divider system 900 with wire frame shelves 750 (FIG. 7) having various dimensions. In the depicted non-limiting example, two shelf dividers 608*a*, 608*b* are employed, which are coupled to the wire frame shelf 750 to create separate bins and/or partitions on the wire frame shelf 750. The shelf dividers 608*a*, 608*b* are secured to the wire frame shelf 750 by a first side 604*a* or 604*b* of the base of the shelf dividers 608*a*, 608*b* that extends around at least a portion of a side of the wire frame shelf 750 as well as a shelf anchor 640*a*, 640*b* configured to anchor the shelf dividers 608*a*, 608*b* to a support member 761*a*, 761*b*, or 761*c*. In addition, the divider system 900 further includes additional shelf anchors 802*a*, 802*b* configured to secure the shelf dividers 608*a*, 608*b* to a cross member 762 of the shelf 650.

Figure 10:
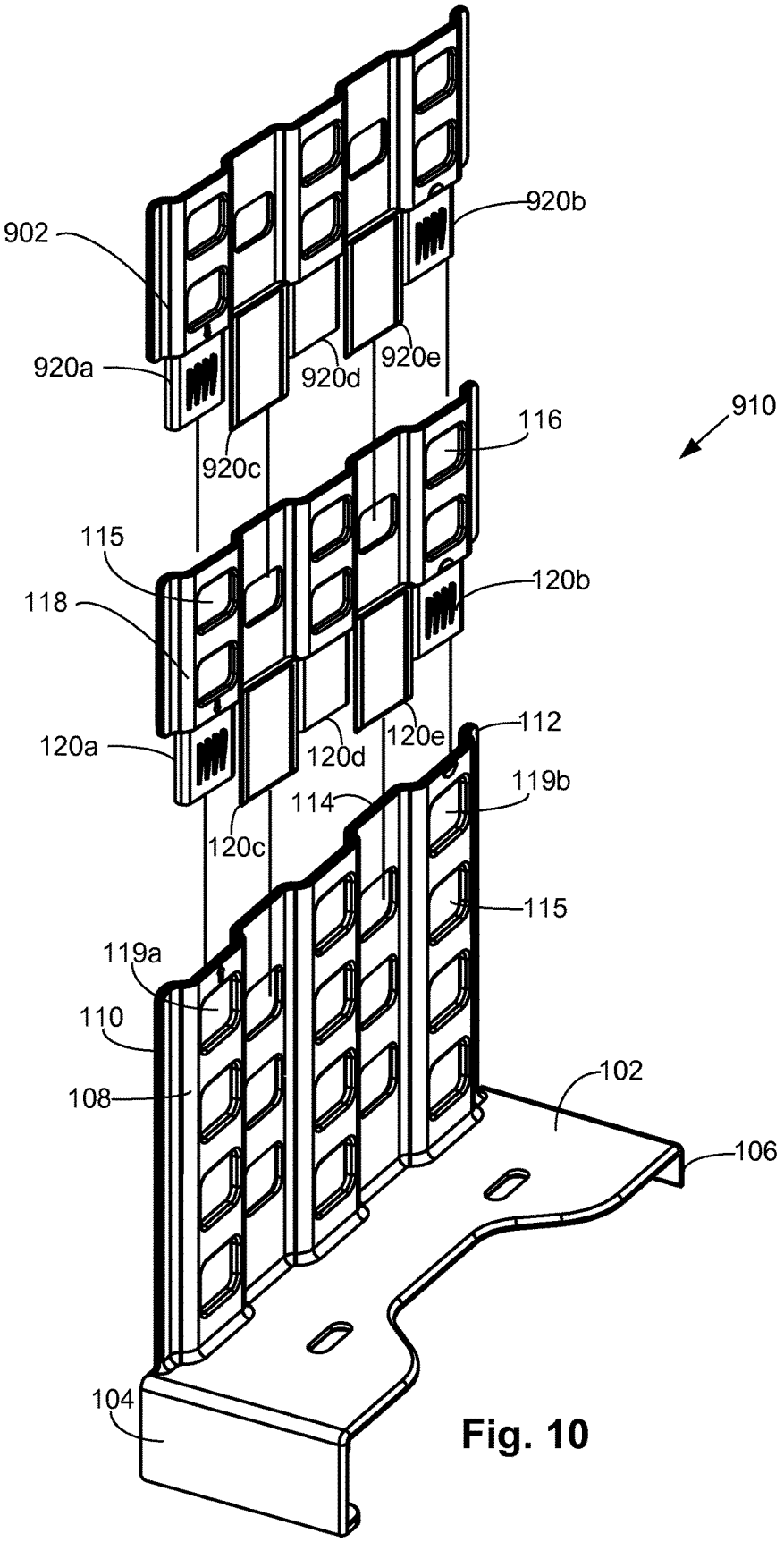
FIG. 10 is a drawing of an alternative non-limiting embodiment of a divider system according to an embodiment of the present disclosure.

Reference is now made to FIG. 10, which depicts another alternative illustration of a shelf divider 910 in accordance with an embodiment of the disclosure. In the depicted embodiment, a second divider extension 902 is connected to the divider extension 118, which provides for additional extendibility and/or configurability of the shelf divider 910.

The second divider extension 910 and divider extension 118 can be connected to one another through use of a connection system configured to facilitate removable attachment to one another. In the depicted example, such a connection system includes one or more connector tabs 920*a*-920*e* configured to attach a second divider extension 910 to a free end of the divider extension 118. A connector tab 920*a*-920*e* may further include projections extending from a side of the connector tab 920*a*-920*e* to facilitate snap fitting of the second divider extension 910 and the divider extension 118. As noted above in reference to FIG. 1, the connection system can also include corresponding connector apertures 115, 116 on the divider extension 118 that are configured to mate with projections extending from a side of the connector tabs 920*a*-920*e* on the second divider extension 910. In this way, longitudinal movement of the second divider extension 910 relative to the divider extension 118 is restricted. As a result, the one or more connector tabs 920*a*-920*e* are configured to secure the second divider extension 910 to the divider extension 118 and further extend (in the depicted non-limiting example) the height of the divider system 100.

Figure 11:
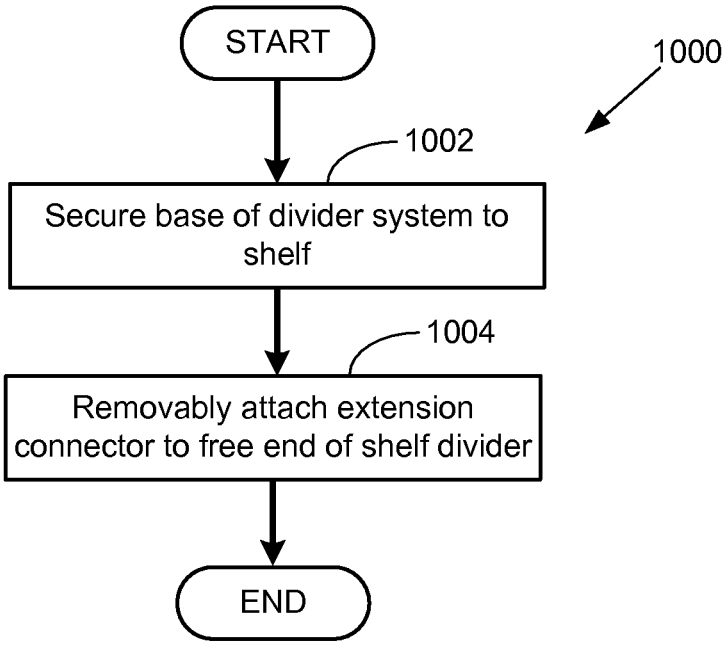
FIG. 11 is a flowchart which depicts one example of a process or method incorporating the divider system of FIG. 1 according to an embodiment of the present disclosure.

Reference is now made to the flow chart FIG. 11, which depicts one example of a process or method 1000 incorporating a divider system 100 (FIG. 1) in accordance with the disclosure. First, in box 1002, a base 102 (FIG. 1) is secured to one or more shelves 202 (FIG. 2). As noted above, the base 102 can include a shelf anchor 540 (FIG. 5) configured to facilitate securing the base 102 to the shelf 202. The base 102 further includes a shelf divider 108 (FIG. 1) extending from the base. The shelf divider 108 is configured to facilitate creation of separate bins and/or partitions on a shelf 202. Next, in box 1004, a divider extension 118 (FIG. 1) is removably attached to a free end of the shelf divider 108 to extend the height, width, and/or length of the divider system 100.

Although the flow chart of FIG. 11 shows a specific order of steps, it is understood that the order of steps may differ from that which is depicted. For example, the order of the blocks may be scrambled relative to the order shown. Also, two or more blocks shown in succession in FIG. 11 may be executed concurrently or with partial concurrence. It is understood that all such variations are within the scope of the present disclosure. It should further be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A divider system, comprising:

a base having a shelf anchor configured to anchor the divider system to a shelf;

a shelf divider extending from a surface of the base and having a body with a plurality of apertures through the shelf divider, the plurality of apertures being staggered in position from a free end of the shelf divider; and a divider extension configured to mate with the shelf divider to lengthen the shelf divider in a direction away from the base when the divider extension is mated with the shelf divider, wherein the divider extension comprises a plurality of connector tabs extending from an end of the divider extension, each of the plurality of connector tabs having at least one snap fit projection configured to snap into at least one of the plurality of apertures of the shelf divider; and wherein the shelf divider includes a first alignment marking that aligns with a second alignment marking on the divider extension.

2. A divider system, comprising:

a base;

a shelf divider extending from a surface of the base, the shelf divider having a plurality of apertures through the shelf divider, the plurality of apertures being staggered in position from a free end of the shelf divider; and a divider extension configured to removably mate with the shelf divider, the divider extension comprising a plurality of connector tabs, each connector tab including a snap fit projection configured to snap into one of the plurality of apertures of the shelf divider, wherein the divider extension is configured to further extend the shelf divider in a direction perpendicular to the base when the divider extension is mated with the shelf divider.

3. The divider system of claim 2, wherein:

the shelf divider includes a first distinct alignment marking and a second distinct alignment marking; and the divider extension includes a first marking that matches and aligns with said first distinct alignment marking and a second marking that matches and aligns with said second distinct alignment marking.

4. The divider system of claim 3, wherein the first distinct alignment marking and the second distinct alignment marking assist a user in attaching the shelf divider to the divider extension.

5. The divider system of claim 2, wherein:

at least one of the plurality of connector tabs includes a first snap fit projection that extends from the at least one of the plurality of connector tabs in a first direction and is configured to snap into a first one of the plurality of apertures at a first distance from the free end of the shelf divider; and at least one other of the plurality of connector tabs includes a second snap fit projection that extends from the at least one other of the plurality of connector tabs in a second direction and is configured to snap into a second one of the plurality of apertures at a second distance from the free end of the shelf divider.

6. The divider system of claim 5, wherein:

the first snap fit projection is configured to snap into the first one of the plurality of apertures from a first direction; and the second snap fit projection is configured to snap into the second one of the plurality of apertures from a second direction opposite to the first direction.

7. The divider system of claim 6, wherein the plurality of apertures comprise a plurality of apertures staggered about alternating regions of a corrugated body of the shelf divider.

8. The divider system of claim 7, wherein the divider extension comprises a plurality of apertures staggered in position from a free end of the divider extension and staggered about alternating regions of a corrugated body of the divider extension.

9. The divider system of claim 2, wherein the shelf divider further comprises a corrugated body, and the divider extension comprises a corrugated body.

10. The divider system of claim 2, wherein the base further comprises a shelf anchor configured to anchor the divider system to a shelf.

11. The divider system of claim 10, wherein:

the base is disposed on an upper surface of the shelf; and the shelf anchor further comprises a first anchor configured to extend around at least a portion of a first side of the shelf.

12. The divider system of claim 11, wherein:

the shelf anchor further comprises a second anchor configured to extend around at least a portion of a second side of the shelf; and the first anchor is further configured and extend over at least a portion of a bottom surface of the shelf.

13. The divider system of claim 10, wherein:

the base is disposed on a wire frame shelf having at least one longitudinal member and a plurality of cross members; and the shelf anchor further comprises a first anchor configured to secure the base to the at least one longitudinal member and to at least one of the plurality of cross members.

14. The divider system of claim 2, wherein the shelf divider is constructed from at least one of: a resin, rubber, silicone, plastic, wood, metal, metal alloy, and fiberglass.

15. The divider system of claim 2, wherein the base further comprises a first side configured to receive a label having product identifying information.

16. A storage system, comprising:

at least one divider system of claim 2; and a shelf, wherein the at least one divider system is coupled to the shelf.

17. A divider system, comprising:

a base that extends along a plane;

a shelf divider extending from a surface of the base, the shelf divider having a plurality of apertures through the shelf divider, the plurality of apertures being staggered in position from a free end of the shelf divider; and a divider extension configured to removably mate with the shelf divider, the divider extension comprising a plurality of connector tabs, each connector tab including a snap fit projection configured to snap into one of the plurality of apertures of the shelf divider, wherein the divider extension is configured to further extend the shelf divider in a direction away from the plane of the base.

18. The divider system of claim 17, wherein the plurality of connector tabs include a first snap fit projection configured to snap into a first of the plurality of apertures from a first direction and a second snap fit projection configured to snap into a second of the plurality of apertures from a second direction.

19. The divider system of claim 17, wherein the divider extension comprises a plurality of apertures staggered in position from a free end of the divider extension.

20. The divider system of claim 19, further comprising a second a divider extension configured to mate with the divider extension, the second divider extension comprising a plurality of connector tabs, each connector tab including a snap fit projection configured to snap into one of the plurality of apertures of the divider extension.

* * * * *